US005404825A

United States Patent [19]

McElwain

[11] Patent Number: 5,404,825

[45] Date of Patent: Apr. 11, 1995

[54] FLOATING DOCK

[76] Inventor: Andrew J. McElwain, R.R. 3, Box 3250, Ste. Genevieve, Mo. 63670

[21] Appl. No.: 141,046

[22] Filed: Oct. 26, 1993

[51] Int. Cl.[6] ..... B63B 35/44

[52] U.S. Cl. ..... 114/263; 114/267

[58] Field of Search ..... 114/263, 266, 267, 65 R, 114/67 R, 68, 69, 357; 405/218, 219; 264/41, 45.1

[56] References Cited

U.S. PATENT DOCUMENTS

| | | | |
|---|---|---|---|
| 1,701,874 | 2/1929 | Donnelly | 114/68 |
| 2,481,821 | 9/1949 | Byrnd et al. | 114/266 |
| 3,152,570 | 10/1964 | Dyer | 114/68 |
| 3,237,218 | 3/1966 | Moore | 114/65 R |
| 3,659,540 | 5/1972 | Toby et al. | 114/266 |
| 3,691,974 | 9/1972 | Seiford, Sr. et al. | 114/266 |
| 3,747,550 | 7/1973 | Stoeberl | 114/39 |
| 3,830,895 | 8/1974 | Theodorsen | 114/65 R |
| 3,840,626 | 10/1974 | Laskawy et al. | 264/45 |
| 3,887,952 | 6/1975 | Nicoll, Jr. | 114/357 |
| 4,136,141 | 1/1979 | Bauer et al. | 264/45.2 |
| 4,161,796 | 7/1979 | Kostanecki | 9/6 P |
| 4,276,844 | 7/1981 | Fremont | 114/39 |
| 4,557,210 | 12/1985 | Gerwin | 114/56 |

*Primary Examiner*—Edwin L. Swinehart
*Attorney, Agent, or Firm*—Paul M. Denk

[57] ABSTRACT

A floating dock includes a surface having top and a bottom, a hollow paperboard tube secured to the bottom of the surface, foam applied to the bottom of the surface to encase the tube, and a coating which encapsulates the surface and the foam.

17 Claims, 3 Drawing Sheets

FLOATING DOCK

BACKGROUND OF THE INVENTION

This invention relates to docks, and, in particular, floating docks.

Floating docks are often used where the water level may change so that the dock surface will always be above water level. Such docks typically include a barrels or a foam, such as styrofoam or a polyurethane foam, to float the dock. The foams are expensive and can be hazardous to the environment if they come apart. Further, floating docks using foam for buoyancy use a considerable amount of foam, and foam is expensive.

SUMMARY OF THE INVENTION

One object of this invention is to provide a floating dock.

Another object is o provide such a doc which educes the amount of foam used to float the dock.

Another object is to provide such a doc which is economical and simple to produce.

These and other objects will become apparent to those skilled in the art in light of the following disclosure and accompanying drawings.

According to the invention, briefly stated, a floating dock of the present invention includes a surface having top and a bottom, a hollow tube secured to the bottom of he surface, foam encasing the tube and a coating which encapsulates the foam and the sides of the surface. The tube is made from paperboard and formed from a blank. Preferably, three blanks are used to form the tube, the bottom and side walls are defined by one blank and the end walls are defined by two identical blanks. Generally C-shaped brackets extend down from the surface at the ends of the surface. The foam is applied to the bottom of the surface between the brackets.

DESCRIPTION OF THE PREFERRED EMBODIMENT

Figure 1:
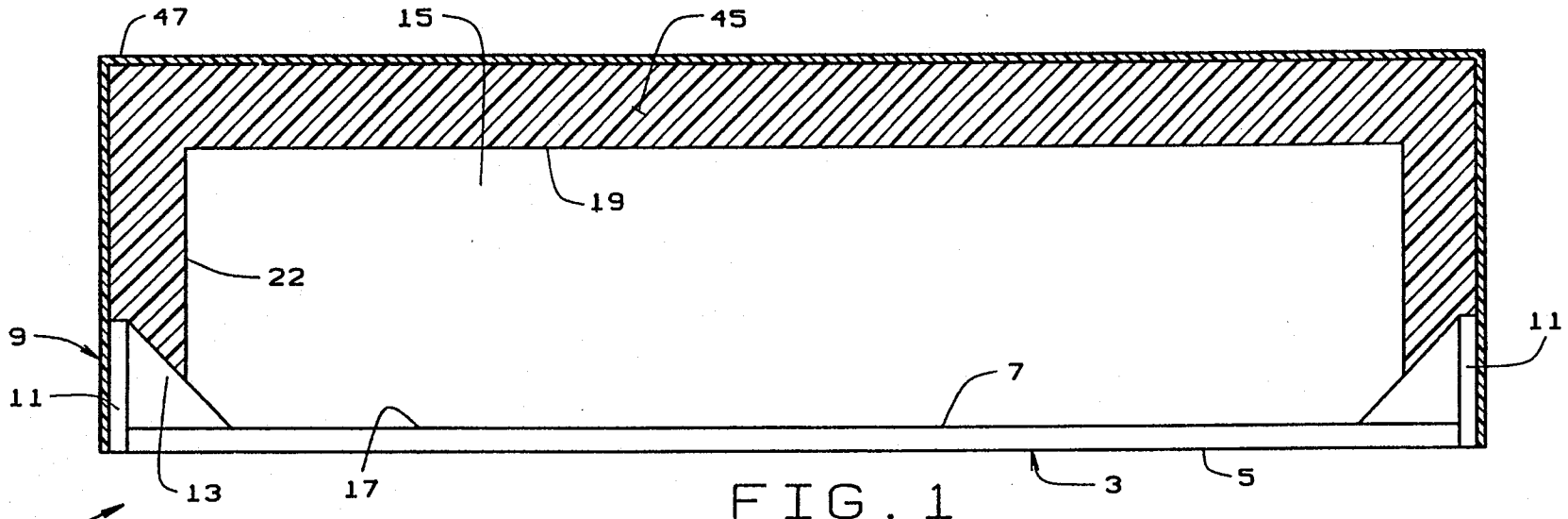
FIG. 1 is a side elevational view, partly in cross-section, of one illustrative embodiment of a floating dock of the present invention.
Figure 2:
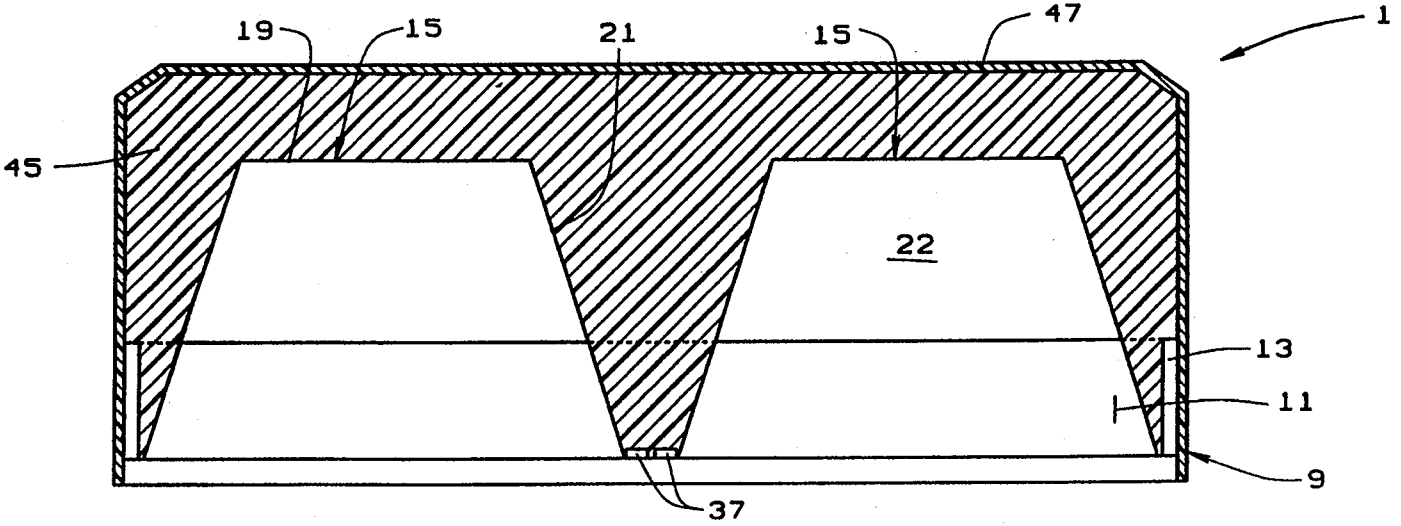
FIG. 2 is an end elevational view, partly in cross-section, of the floating dock.

Referring now to the FIG. 1, reference numeral 1 indicates one illustrative embodiment of a floating dock of the present invention. Dock 1 includes a board or surface 3 having a top 5 and a bottom 7. Surface 5 is the weather surface or the exposed surface upon which people will walk. It is preferably made from ½" plywood and is elongate. Preferably, board 3 has dimensions of 7.5'×4 ', but other dimensions could be used Brackets 9 are applied to surface bottom 7 at the ends thereof. Brackets 9 include a leg 11 which extends substantially the width of surface 3. Legs 11 are preferably also wooden and are made from 2"×8 " blocks. Side legs 13 extend inwardly from the sides of legs 11. Brackets 9 thus have are generally C-shaped. Legs 13 have one edge adjacent to their respective legs 11 and another edge adjacent surface bottom 7. Side legs 13 are preferably triangular, but could be any desired shape, e.g. Rectangular, arced, etc. To securely adhere brackets 9 to surface 3, legs 13 are secured to both surface bottom 7 and legs 11 using glue, fasteners, or any other desired means.

Figure 3:
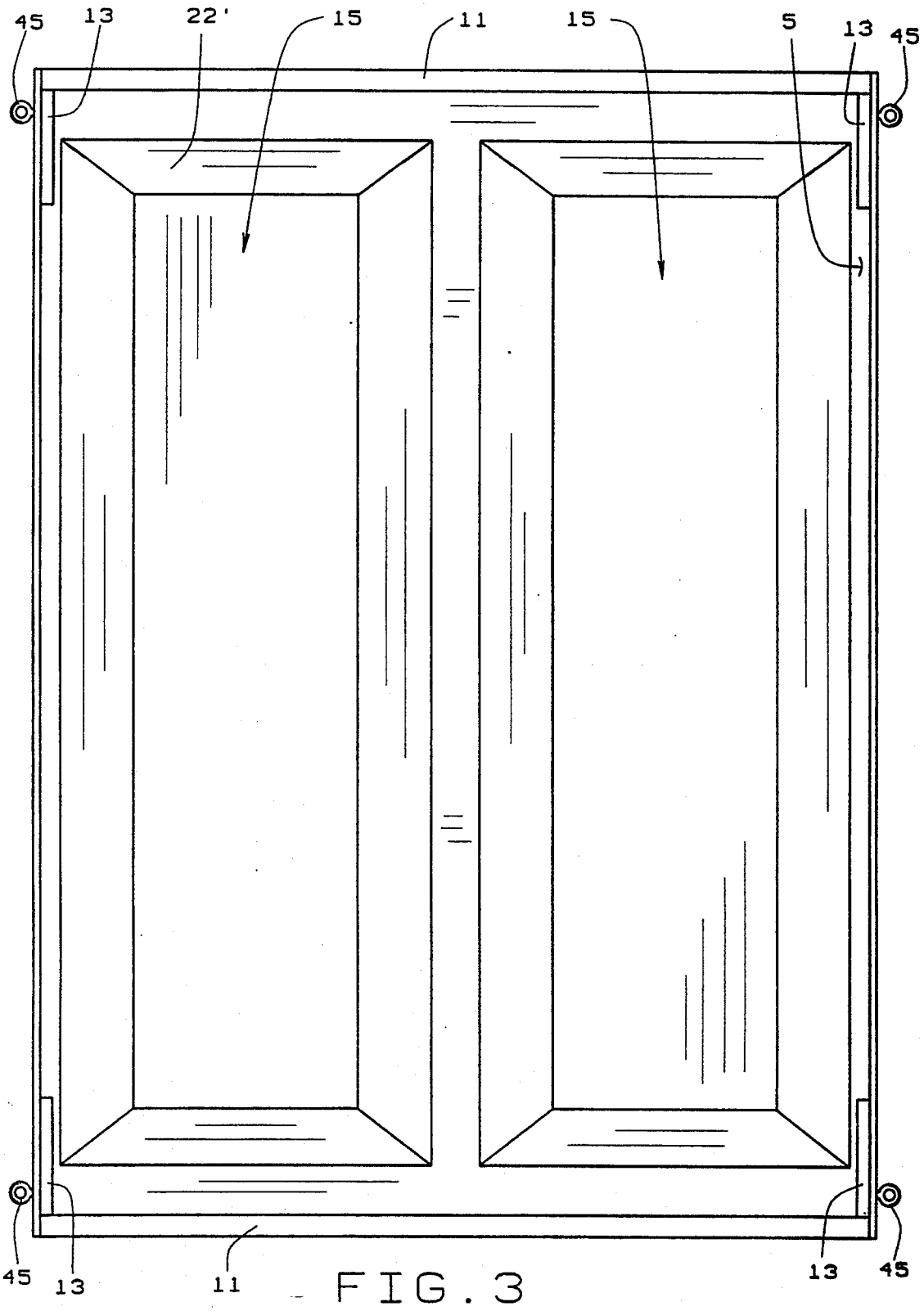
FIG. 3 is a bottom plan view of floatation tubes applied to a surface of the dock.
Figure 4:
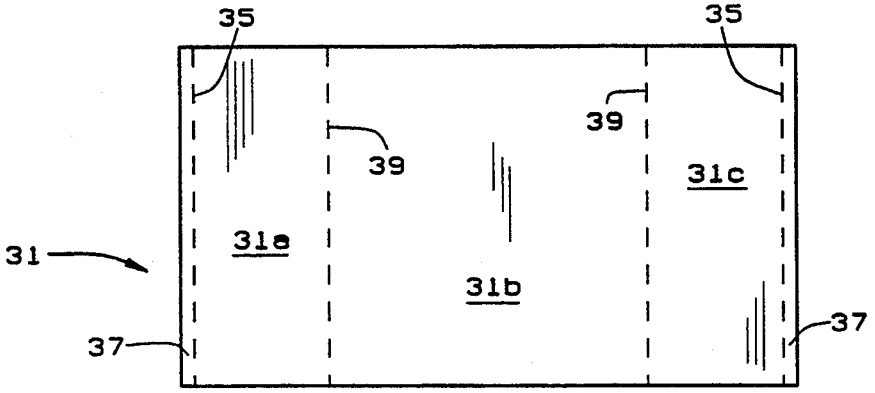
FIG. 4 is a plan view of a blank which forms the body of the flotation tubes.
Figure 5:
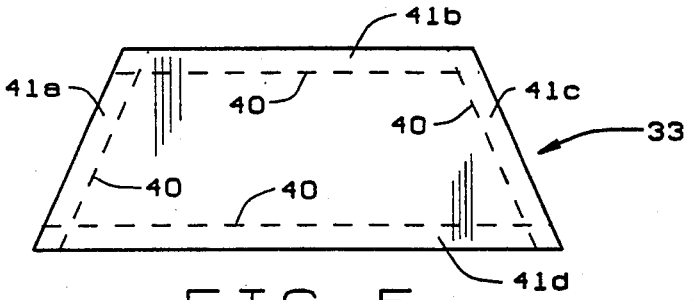
FIG. 5 is a plan view of a blank which forms the ends of the floatation tubes.

Hollow blocks or tubes 15 are secured to surface bottom 7. Tubes 15 are elongate, but shorter than surface 3 and are centered with respect to the elongate axis of surface 3. Preferably, the ends of tubes 15 are spaced at least four inches from the brackets 9. Although one tube 15 could be used, preferably there are two such tubes. Tubes.15 are generally trapezoidal in shape, having a top 17, a bottom 19, diagonal side walls 21, and end walls 22. The top 17 is wider in cross-section than bottom 19 to give tube 15 a trapezoidal cross-section. The end walls may be vertical such as end walls 22 of FIG. 1 or sloped such as end walls 22' of FIG. 3.

Figure 6:
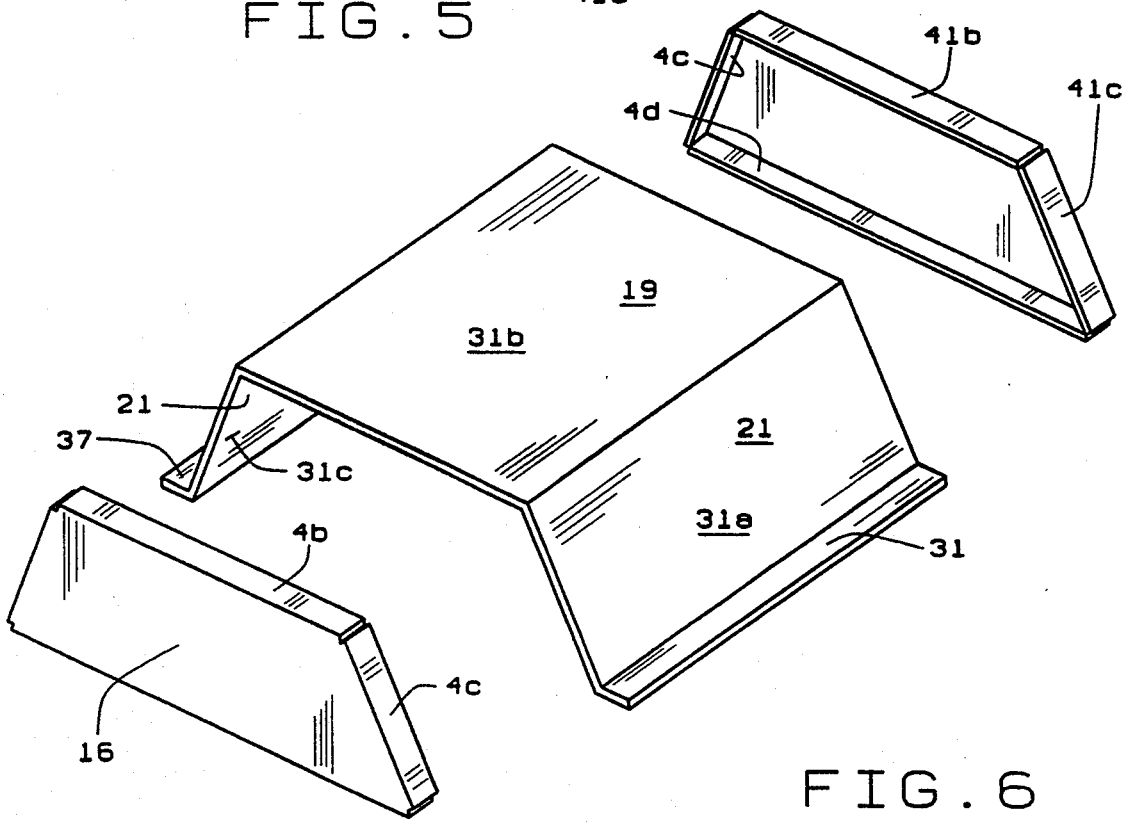
FIG. 6 is an exploded view of the flotation tube assembly.

Tubes 15 are formed from a paperboard blank 31 which forms the elongate body of tube 15 and a pair of blanks 33 which form the end walls of the tube 15. For the preferred surface 3 which is 7.5' long and 4' wide, blank 31 is preferably 88"×49.75". Blank 31 is scored as at 35, approximately 1" from the ends of the blank, to form tabs 37. The blank is also scored, as at 39 to divide the blank into three sections 31*a*, 31*b*, and 31*c*. Sections 31*a* and 31*c* are of equal size. The blank is folded along scores 39 such that blank sections 31*a* and 31*c* form the elongate sides 21 of tubes 15 and the middle section 31*b* forms the bottom 19 of the tubes. Tabs 31 are folded to lie flat against the bottom 7 of surface 3 to secure the folded blank to the surface. This forms an open ended tube wherein surface bottom 7 forms the top 17 of tube 15. The ends are closed by blanks 33. Blanks 33 are cut to the desired cross-sectional shape of the tube 15. They are scored, as at 40, to form tabs 41*a–d*. When the folded blank 33 is attached to the folded blank 31, the tabs 41*a–d* are placed adjacent the surfaces of the folded blank 31 so that the blank 33 may be secured to the blank 31. The bottom tab 41*d* is secured to the surface bottom 7. (FIG. 6).

When the tubes 15 are secured to surface bottom 7, foam is applied to the bottom 7 to encase the tubes 15. The foam is preferably a urethane foam such as Freeman 30-2160/30-2030 sold by Freeman Chemical Corporation of Port Washington, Wis. The foam is applied so that it is at least four inches thick, i.e. It extends at least four inches from the outer surfaces of tubes 15. A foam thickness of at least 4" protects the paperboard tube from water and the elements and, in conjunction with the hollow tube, provide sufficient buoyancy to the dock to float the dock surface 5 above water under normal use conditions. As can be seen, the foam is preferably applied so that the bottom of the dock is generally planar.

After the foam is applied, a coating 47 is applied to the assembly which surrounds the foam and extends up to the top of surface 3. Coating 47 is preferably a liquid urethane base coat, such as is supplied by Ga co Western, Inc., of Seattle, Wash. Under the product code Central UB-7050. The coating 47 is applied to a thickness of 20 mils (dry). A thin coating is also applied to the top 5 of surface 3. The coated surface 5 may be covered with carpeting or a non-skid surface if desired.

To produce the floating dock 1, tubes 15 are folded and secured to the bottom 5 of surface 3. With the tubes 15 in place, the assembly is placed in a vented clam-shell mold. The foam is then applied to the part and expands to fill all the cavities. The part is removed from the clam-shell mold once the foam sets.

With the part removed, the assembly is suspended so that the coating 47 may be applied. To suspend the part, holes are drilled in the sides of the part near the corners so that eye bolts 45 may be screwed into the bracket see FIG. 3 Preferably, the eye bolts are screwed into the triangular side legs 13. Ropes or the like are used to suspend the part so that the coating may be applied thereto. Once the coating is applied, the dock is complete and ready for insulation.

As can be seen, the dock of present invention eliminates a substantial amount of foam. With the dimensions given, the tubes displace 23.8 cu. ft.—which correlates to a displacement of 23.8 cu. ft. of foam which would have otherwise been used. This thus creates a lighter dock which floats exceedingly well.

Obviously, all weather carpeting, or the like, can be applied to the surface and to furnish a finished floor available for ready usage upon installation of the fabricated dock. Also, a series of these docks can be assembled together, when forming a dock, to enlarge its size.

Variations within the scope of the appended claims may be apparent to those skilled in the art. For example, the dimensions of the dock may be changed. The dock may be made of sections, formed as described above, to create an even longer dock. The tubes 15 could extend the width of board 3 rather than the length. Only one tube could be used or more than two tubes could be used. A single blank may be used to make the tube 15 with its end walls, rather than the use of multiple blanks as disclosed. The blank could define a top of the tube, rather than forming an open topped tube, the top of which is defined by the board 3. These examples are merely illustrative.

I claim:

1. A floating dock including a surface having top and a bottom, a hollow tube secured to the bottom of said surface, said tube being made of paperboard, foam encasing said tube, and said foam having exteriorly exposed surfaces, and a coating which completely encapsulates the exteriorly exposed surfaces of said foam, bracketing means to position said tube and said foam on the bottom of said dock surface, said bracketing means including an end leg extending downwardly from an end of said surface, said end leg having sides, and side legs extending inwardly from the sides of said end leg.

2. The floating dock of claim 1 wherein said foam is at least four inches thick.

3. The floating dock of claim 1 wherein said hollow tube includes at least two hollow tubes.

4. The floating dock of claim 1 wherein the tube is formed from a blank defining a bottom, side walls, and end walls.

5. The floating dock of claim 4 wherein the blank includes score lines defining tabs, said tabs being adjacent said surface to secure said tube to said surface.

6. The floating dock of claim 5 wherein said tube is made from a plurality of blanks, said bottom and side walls being defined by one blank and said end walls being defined by second blanks.

7. The floating dock of claim 1 wherein said bracketing means side legs are triangular.

8. The floating dock of claim 1 wherein said tube is trapezoidal in cross-section.

9. A floating dock including a surface having top and a bottom;

a hollow paperboard tube secured to the bottom of said surface;

foam applied to the bottom of said surface and encasing said tube;

a coating which encapsulates said foam; and bracketing means to position said tubes and said foam on the bottom of said surface, said bracketing means including an end leg extending downwardly from an end of said surface and side legs extending inwardly from the sides of said end leg.

10. The floating dock of claim 9 wherein said foam is at least four inches thick.

11. The floating dock of claim 9 including two hollow tubes.

12. The floating dock of claim 9 wherein said bracketing means side legs are triangular.

13. The floating dock of claim 9 wherein said tube is generally trapezoidal.

14. A method for producing a floating dock including supplying a surface having a top and a bottom, and said surface having ends;

adhering at least one hollow tube to the bottom of said surface;

applying bracketing means to the bottom of said surface proximate its ends;

applying a foam to the bottom of said surface to encapsulate said at least one hollow tube; and encasing said surface and foam with a coating, whereby the completed floating dock may be inverted with the top of the surface directed upwardly, and the applied foam encasing the one hollow tube and its end brackets extending downwardly when installed in water.

15. The method of claim 14 wherein said step of applying said foam includes applying said foam to at least a thickness of four inches from the surfaces of said hollow tube.

16. The method of claim 14 wherein the step of encasing said surface and foam includes a step of suspending said surface and foam.

17. The method of claim 16 wherein said suspending step includes securing eyes to said bracketing means.

* * * * *